US007374400B2

(12) United States Patent
Boswell

(10) Patent No.: US 7,374,400 B2
(45) Date of Patent: May 20, 2008

(54) TURBINE BLADE ARRANGEMENT

(75) Inventor: John Harold Boswell, Derby (GB)

(73) Assignee: ROLLS-ROYCE plc, London (GB)

( * ) Notice: Subject to any disclaimer, the term of this patent is extended or adjusted under 35 U.S.C. 154(b) by 220 days.

(21) Appl. No.: 11/050,941

(22) Filed: Feb. 7, 2005

(65) Prior Publication Data

US 2005/0196278 A1 Sep. 8, 2005

(30) Foreign Application Priority Data

Mar. 6, 2004 (GB) ..... 0405162.9

(51) Int. Cl.
*F01D 5/08* (2006.01)

(52) U.S. Cl. ..... 416/97 R; 416/95; 416/96 A; 416/190; 416/193 A; 416/500

(58) Field of Classification Search ..... 416/95, 416/96 R, 96 A, 97 R, 190, 193 A, 248, 416/500; 415/115
See application file for complete search history.

(56) References Cited

U.S. PATENT DOCUMENTS 3,266,771 A * 8/1966 Morley ..... 416/190
3,658,439 A 4/1972 Kydd
3,709,631 A * 1/1973 Karstensen et al. ..... 416/95
3,897,168 A 7/1975 Amos
4,457,668 A 7/1984 Hallinger
5,244,345 A 9/1993 Curtis
5,281,097 A * 1/1994 Wilson et al. ..... 416/193 A
5,388,962 A 2/1995 Wygle et al.
5,827,047 A * 10/1998 Gonsor et al. ..... 416/193 A
6,017,189 A * 1/2000 Judet et al. ..... 416/97 R
6,457,935 B1 * 10/2002 Antunes et al. ..... 415/115

FOREIGN PATENT DOCUMENTS

GB 755290 8/1956
GB 1084606 9/1967
GB 1259750 A * 1/1972

* cited by examiner

*Primary Examiner*—Christopher Verdier
(74) *Attorney, Agent, or Firm*—Oliff & Berridge, PLC

(57) ABSTRACT

A turbine blade arrangement comprises turbine blades which are secured in adjacent positions to a rotor disc with a cavity defined between root segments and platform segments. A flow deflector within the cavity is provided as an insert such that through a recessed portion coolant flow .from a coolant path is constrained to remain adjacent to a rim surface. By constraining the coolant flow to remain adjacent to the surface greater cooling efficiency is achieved. Inner surfaces of the deflector may also be coated with low emissivity materials to reduce radiant heat flux transfer. The flow deflector supports a damper member in association with the platform segments.

5 Claims, 2 Drawing Sheets

TURBINE BLADE ARRANGEMENT

The present invention relates to turbine blade arrangements and more particularly to arrangements for mounting turbine blades to a rotor disc.

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15, a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts.

Engine efficiency is highly dependent upon operating temperatures, but higher operating temperatures cause problems with respect to the physical capabilities of the component materials. In such circumstances coolant air flows are utilised to ensure that components remain within acceptable temperature ranges for operational reliability and endurance. A particular problem is presented by the turbine blades in rotor disc mountings which form the turbine stages 16, 17, 18 depicted in FIG. 1. It will be understood that the blades are subjected to high gas temperatures and so the components will also be heated by that hot gas. As indicated it is known to provide coolant air taken from the compressor stages of an engine in order to create necessary cooling of turbine components.

Turbine blades are typically mounted through root sections of reciprocal shaping with apertures in rotor discs. The turbine blades are secured in side by side locations with platform sections extending between each blade in order to create through juxtaposed edges of those platform sections a substantially gas tight peripheral rim. Between each turbine blade root section a cavity is generally formed within which a damper member is provided to limit hot gas ingression through the juxtaposed joint between platform sections and also reduce vibration chatter. Cooling is achieved by presentation of a coolant path into the cavity.

From the above it will be appreciated that the cavity is relatively large and so leakage of coolant flow through a radial passage, commonly referred to as a 'Bayley Groove' is volumetrically proportionately inefficient.

In accordance with the present invention there is provided a turbine blade arrangement comprising a rotor disc within which a coolant path is formed towards a cavity between adjacent rotor blades, the cavity is defined between respective root sections of adjacent rotor blades and the cavity is formed above a rim section of the rotor disc, a flow diverter comprising a recessed portion is located within the cavity, the recessed portion in use diverting coolant flow from the coolant path to remain adjacent the rim section of the rotor disc.

Also in accordance with the present invention there is provided a flow diverter for a turbine blade arrangement, the diverter comprising a recessed portion for location in use above a coolant path into a cavity formed above a rotor disc rim section by adjacent turbine blade root sections, the recessed portion diverting any coolant flow in use from the coolant path to remain adjacent to the rim section of the rotor disc.

Generally, an upper part of the cavity is formed by respective rim platform sections of the adjacent turbine blade root sections brought together to form a juxtaposition joint.

Normally, the flow diverter is arranged to support any damper member utilised with respect to providing a gas seal and/or vibration chatter resistance in use relative to the adjacent turbine blades.

Normally, the flow diverter comprises a U-shaped insert with two upstanding arms and recessed portion in a base extending between the upstanding arms. Typically, the arms engage portions of the cavity in order to present a downward biased pressure upon the rim section to effect a seal either side of the coolant path.

Typically, the flow diverter is integral with a damper member.

Possibly, the flow diverter includes a low emissivity coating to reduce radiation heat flux and transfer within the cavity.

Advantageously, at least one end of the flow diverter is closed whilst at least part of the recessed portion has perforations such that coolant flow sprays through those perforations for impingement cooling within the cavity.

Embodiments of the present invention will now be described by way of example and with reference to the accompanying drawings in which.

Figure 1:
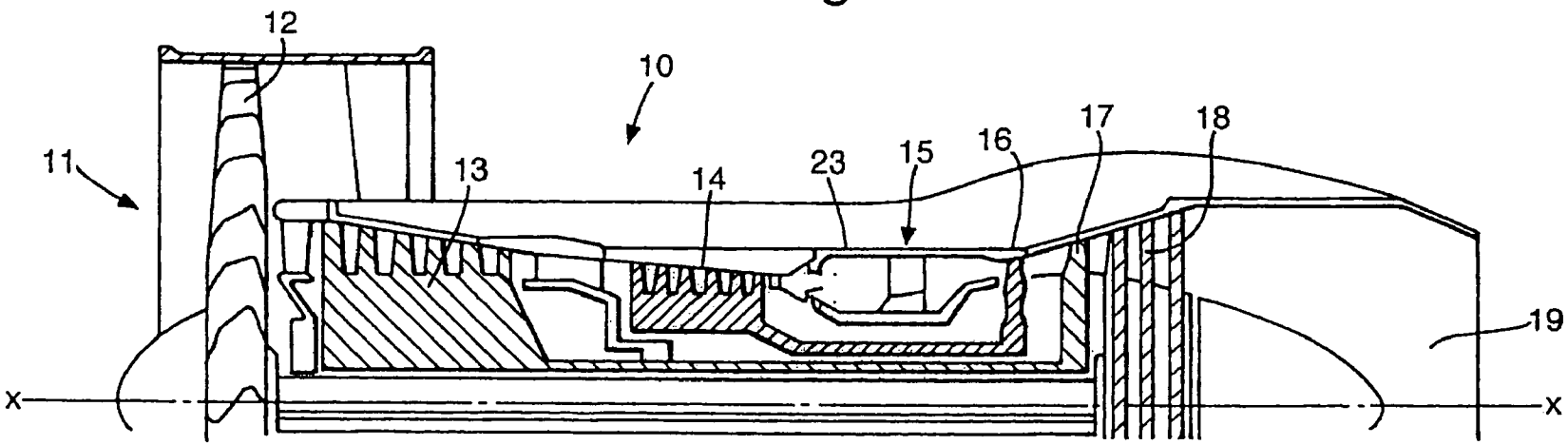
FIG. 1 shows a sectional side view of a gas turbine engine.
Figure 2:
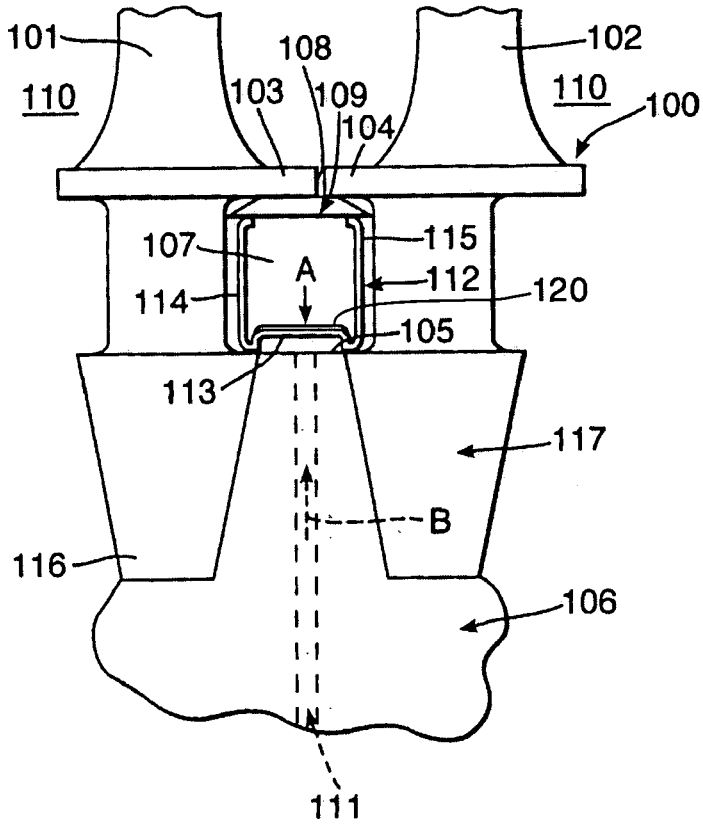
FIG. 2 is a schematic front elevation of a turbine blade arrangement in accordance with the present invention; and, FIG. 3 is a schematic side elevation of the arrangement depicted in FIG. 2.
Figure 3:
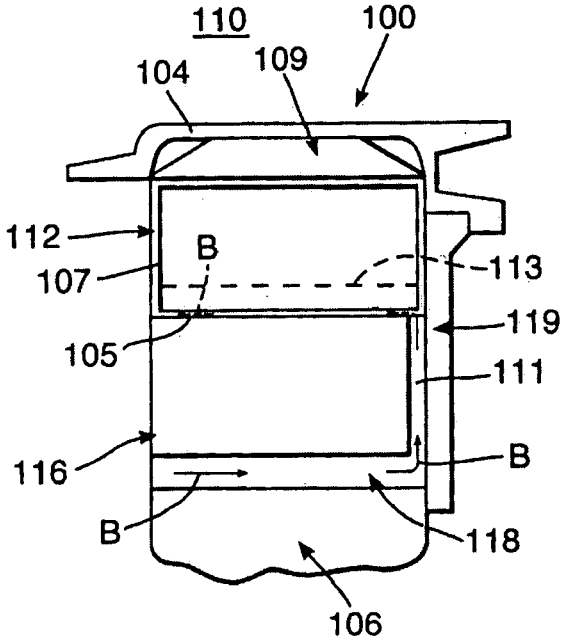

FIGS. 2 and 3 depict a turbine blade arrangement in front elevation and side elevation, respectively in accordance with the present invention. Thus, as is known from previous arrangements, turbine blades 101, 102 have root sections incorporating platforms 103, 104 which are held in juxtaposed position in order to define a cavity 107 with other root segments and a rim section 105 of a rotor disc 106. It will be understood that typically an assembly of arrangements 100 in accordance with the present invention will be provided around the circumference of a rotor disc 106 in order to create a turbine stage (16, 17, 18) as depicted in FIG. 1. Between the platform sections 103, 104 a juxtaposition joint 108 is created by abutment between edge surfaces of those platform sections 103, 104. A damper member 109 is provided below the joint 108 in order to further facilitate gas sealing as well as provide resistance to vibration chatter of the blades 101, 102 in operation. The damping member 109 will typically be of a so called cottage roof type forced into compressive engagement with the joint 108.

As indicated above, hot combustion gases will generally be in the area 110 about the turbine blades 101, 102. It is these hot gases which heat the components of the arrangement 100. In order to cool the arrangement 100 a coolant path 111 is provided which extends from a coolant network typically supplied from the compressor side of a turbine engine, but not further depicted in the drawings. This coolant path may be referred to as a "Bayley Groove". As indicated previously, a simple groove to provide the path 111 into the cavity 107 is relatively inefficient. It will be understood that preferably in order to protect the rim section 105 the coolant flow should be held adjacent to that rim 105 surface for greatest effect.

In accordance with the present invention a flow diverter 112 is provided within the cavity 107. The flow diverter 112 incorporates a recessed portion 113 above the coolant path 111. In the preferred form depicted in the figures, the flow diverter 112 essentially comprises a U-shaped insert having upstanding arms 114, 115 which extend on either side of a base section incorporating the recessed portion 113. The recessed portion is located underneath a floor connected at the base. In these circumstances a coolant gallery is constituted between the rim surface 105 and an inner surface of the recessed portion 113 within which coolant flow is confined adjacent to that surface 105 whereby cooling efficiency is improved.

As depicted in the figures the flow diverter 112 generally supports the damper member 109 in engagement below the platform sections 103, 104. The flow diverter 112 as depicted in the form of an insert is formed from a material which can withstand the expected operating temperatures within the cavity 107 between the hot gases in the areas 110 about the blades 101, 102 and the rotor disc 106 incorporating apertures to accept root mountings 116, 117 in reciprocal apertures. It is also advantageous if the flow diverter 112 is formed from a material which will allow slight compression such that a downward bias pressure can be exerted in the direction of arrowhead A to create a seal either side of the coolant path 111. In order to facilitate such downward bias pressure, top parts of the upstanding arms 114, 115 may be rounded in order that through sprung displacement the desired downward bias is achieved. Nevertheless, a perfect seal on either side of the coolant gallery and the surface 105 is not required as any leakage will still provide cooling effect within the cavity 107 and simulate at least a trickle flow.

As particularly depicted in FIG. 3, the coolant path 111 extends upwards from a coolant network generally at the base of the blade root segments 116, 117. In such circumstances, the coolant flow initially passes through a so called bucket groove 118 until it engages a locking plate 119 which in association with the "Bayley Groove" formed in the root section 116 defines the coolant path upwards towards the recessed portion 113. In such circumstances, the coolant flow follows arrowheads B within the arrangement 100 into the cavity 107. Generally, by use of the recessed portion 113 within the flow diverter 112, it will be understood that a conduit is created whereby the coolant flow is deflected and constrained to remain near to the rim surface 105 of the rotor disc 106 within the gallery formed. In such circumstances, the coolant flow B is not diluted in the greater volume of the cavity 107 and so achieves through a higher initial retained temperature differential better cooling of the rim surface 105. It will also be understood that retaining the coolant flow near to the surface 105 creates a coolant film barrier to resist heat transfer to the surface 105 from the cavity 117.

It is the platform sections 103, 104 which as indicated become hot due to gases in the areas 110 about the blades 101, 102. In such circumstances there will be significant heat radiation through the cavity 107 towards the rotor disc surface rim section 105 unless such reduction is controlled. In order to inhibit this heat radiation, at least inner surfaces of the recessed portion 113 and possibly upstanding arms 114, 115 may be coated with a low emissivity coating 120 or formed from low heat emissivity materials to resist heat transfer from the platform sections 103, 104 to the rim section surface 105. In such circumstances other cooling mechanisms, that is to say convection and conduction within the arrangement 110 may be rendered more effective.

In order to maintain cooling it will be appreciated that coolant flow should be maintained through the channel formed between the recess portion 113 and the surface 105. The rate of such flow will be determined by operational requirements, but as indicated provides both active cooling by convection into the coolant flow B as well as creating a standing or lingering coolant film barrier within the constituted channel, particularly if the flow diverter 112 has been rendered less susceptible to heat transfer itself.

Typically, as indicated the flow diverter 112 will take the form of an insert within the cavity 107. This insert may be manufactured as an extrusion or forged from sheet material or cast as an appendix component to a damper member 109, that is to say the damper member 109 and the flow deflector 112 are formed as an integral unit.

As indicated above, the rate of coolant flow B will be determined by operational requirements. Nevertheless, such flow may be achieved through pre-determined leakage through apertures formed in the recessed portion 113. In such circumstances coolant flow will pass through the apertures or perforations in the recess portion 113 in order to create a coolant spray into the cavity 107. This coolant spray will then impinge upon surfaces within the cavity 107 including parts of the turbine blade root sections, the flow deflector upstanding arms 114, 115 and damper member 109 in order to again provide cooling within that cavity. These perforations or apertures will be formed by drilling holes into the recessed portion 113 whilst at least one end of the recess portion will be closed in order to force spray ejection of coolant flow through the perforations or apertures in the recessed portion 113. It will be understood that these perforations may be arranged such that there is an even distribution across the recess portion 113 or perforations provided in an appropriate pattern to maximize spray impingement upon surfaces within the cavity 107 for cooling effect. In such circumstances the perforations may be arranged to be principally positioned at the peripheral margins adjacent to the surfaces to be cooled within the cavity 107 in order to maximize impingement upon those surfaces. Furthermore, where possible and where there is sufficient material thickness in the recessed portion 113 it will be appreciated that the perforations or apertures may be angled for jet projection towards the surfaces for impingement cooling as required.

As indicated above, generally a turbine blade assembly will be formed from a number of arrangements as described about the peripheral circumference of a rotor disc. Thus, between each adjacent turbine blade and in particular root segments of those adjacent turbine blades, a flow deflector typically in the form of an insert as depicted in FIGS. 2 and 3 will act to inhibit heat transfer to the rim surface 105 as well as provide cooling efficiency of that surface 105. Generally it will be understood that the degree of additional cooling is dependent upon coolant flow rates, coolant path effects prior to the gallery formed between the recess portion 113 and the surface 105, along with other effects such as low emissivity coatings, etc, but generally it is expected that a like for like reduction in rotor disc temperature in the order of 50 to 60K will be achievable.

Such reductions in temperature allow for designed improvements in cooling efficiency or reduction in the required coolant bleed for the same cooling effect or allow for actual reduction in the operational temperature of the rotor disc.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A turbine blade arrangement comprising:

a rotor disc having turbine blades mounted thereon, said turbine blades having platform sections and said rotor disc having a coolant path directed towards a cavity between adjacent turbine blades, said cavity being defined by respective blade platforms of adjacent turbine blades brought together to form a juxtaposition joint, respective root sections of adjacent rotor blades and a rim section of the rotor disc, said cavity having a flow diverter located therein comprising an insert having a base adjacent to and engaging said rim section and including a recessed portion located underneath a floor connected at the base, the recessed portion in use diverting coolant flow from the coolant path to remain adjacent the rim section of the rotor disc, said flow diverter additionally being arranged to support a damper member in engagement with said juxtaposed turbine blade platform sections.

2. A turbine blade arrangement according to claim 1, wherein the flow diverter comprises a U-shaped insert with two upstanding arms, said base extending between the upstanding arms.

3. A turbine blade arrangement according to claim 2, wherein the arms engage portions of the cavity in order to present a biased pressure upon the rim section to effect a seal on either side of the coolant path.

4. A turbine blade arrangement according to claim 1, wherein the flow diverter includes a coating to reduce radiation heat flux and transfer within the cavity.

5. A turbine blade arrangement according to claim 2, wherein at least one end of the flow diverter is closed while at least part of the recessed portion has perforations such that coolant flow sprays through the perforations for impingement cooling within the cavity.

* * * * *